US007431272B2

(12) United States Patent
Melen et al.

(10) Patent No.: US 7,431,272 B2
(45) Date of Patent: Oct. 7, 2008

(54) DEVICE FOR STIRRING A LIQUID AND INJECTING A GAS INTO SAID LIQUID WITH LIMITED CLOGGING

(75) Inventors: Stephane Melen, Saint Crespin s/Moine (FR); Catherine Xuereb, Pechabou (FR); Martine Poux, Toulouse (FR); Rodolphe Sardeing, Toulouse (FR)

(73) Assignees: L'Air Liquide, Societe Anonyme A Directoire et Conseil de Surveillance pour l'Etude et l'Exploitation des Procedes Georges Claude, Paris (FR); Centre National de la Recherche Scientifique, Paris (FR); Institut National Polytechnique de Toulouse, Paris (FR)

( * ) Notice: Subject to any disclaimer, the term of this patent is extended or adjusted under 35 U.S.C. 154(b) by 53 days.

(21) Appl. No.: 10/538,706

(22) PCT Filed: Dec. 4, 2003

(86) PCT No.: PCT/FR03/50151

§ 371 (c)(1),
(2), (4) Date: Nov. 21, 2005

(87) PCT Pub. No.: WO2004/054694

PCT Pub. Date: Jul. 1, 2004

(65) Prior Publication Data

US 2006/0151897 A1 Jul. 13, 2006

(30) Foreign Application Priority Data

Dec. 12, 2002 (FR) ..... 02 15733

(51) Int. Cl.
*B01F 3/04* (2006.01)

(52) U.S. Cl. ..... 261/87; 261/93; 261/123

(58) Field of Classification Search ..... 261/87, 261/91, 93, 123
See application file for complete search history.

(56) References Cited

U.S. PATENT DOCUMENTS

| | | | | | |
|---|---|---|---|---|---|
| 3,067,988 | A | * | 12/1962 | Rodoz | 261/29 |
| 3,490,996 | A | * | 1/1970 | Kelly, Jr. | 202/234 |
| 3,953,552 | A | * | 4/1976 | Strauss | 261/93 |
| 4,193,949 | A | * | 3/1980 | Naito | 261/87 |
| 4,454,078 | A | * | 6/1984 | Engelbrecht et al. | 261/93 |
| 5,643,503 | A | * | 7/1997 | Roland | 261/30 |
| 6,109,449 | A | * | 8/2000 | Howk et al. | 209/169 |

(Continued)

FOREIGN PATENT DOCUMENTS

| | | |
|---|---|---|
| DE | 11 89 952 | 4/1965 |

(Continued)

OTHER PUBLICATIONS

International Search Report for PCT/FR03/50151.

*Primary Examiner*—Scott Bushey
(74) *Attorney, Agent, or Firm*—Christopher J. Cronin

(57) ABSTRACT

An apparatus for stirring and injecting a gas into a liquid. A drive device, located above a container containing a liquid, is connected to a vertical output shaft. The shaft has a self-suction turbine at its. The turbine is made of two stacked disks where the surface area of the lower disk is less than the surface area of the upper disk.

7 Claims, 4 Drawing Sheets

U.S. PATENT DOCUMENTS

| | | | | |
|---|---|---|---|---|
| 6,126,150 | A * | 10/2000 | Van Dyk | 261/87 |
| 6,270,061 | B1 | 8/2001 | Bouquet et al. | |
| 6,712,980 | B1 * | 3/2004 | Ahlstrom | 210/758 |
| 6,799,683 | B2 * | 10/2004 | Jounela et al. | 209/169 |

FOREIGN PATENT DOCUMENTS

| | | |
|---|---|---|
| DE | 295 06 955 | 6/1995 |
| EP | 0 995 485 | 4/2000 |

* cited by examiner

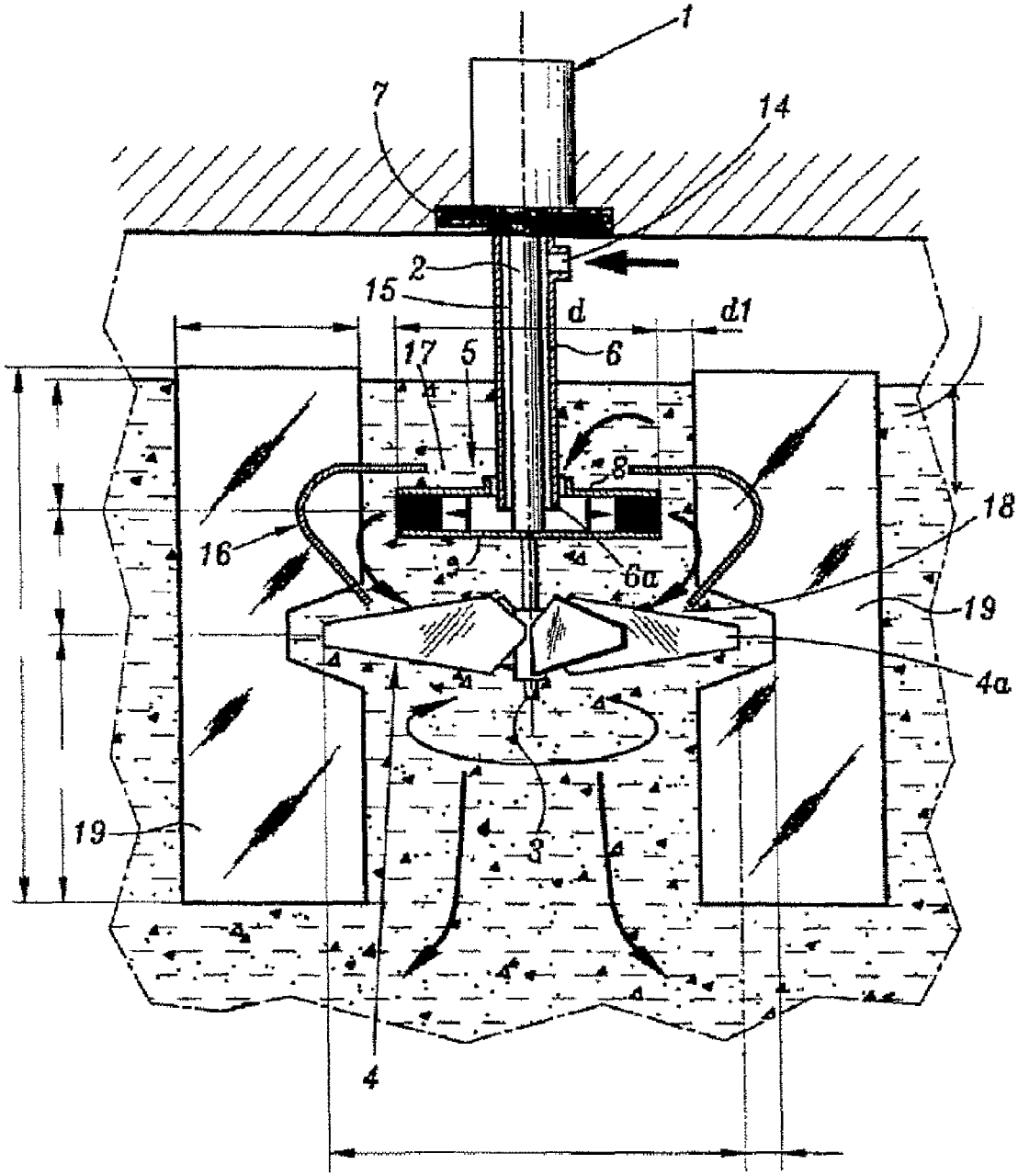
FIG 1A: PRIOR ART

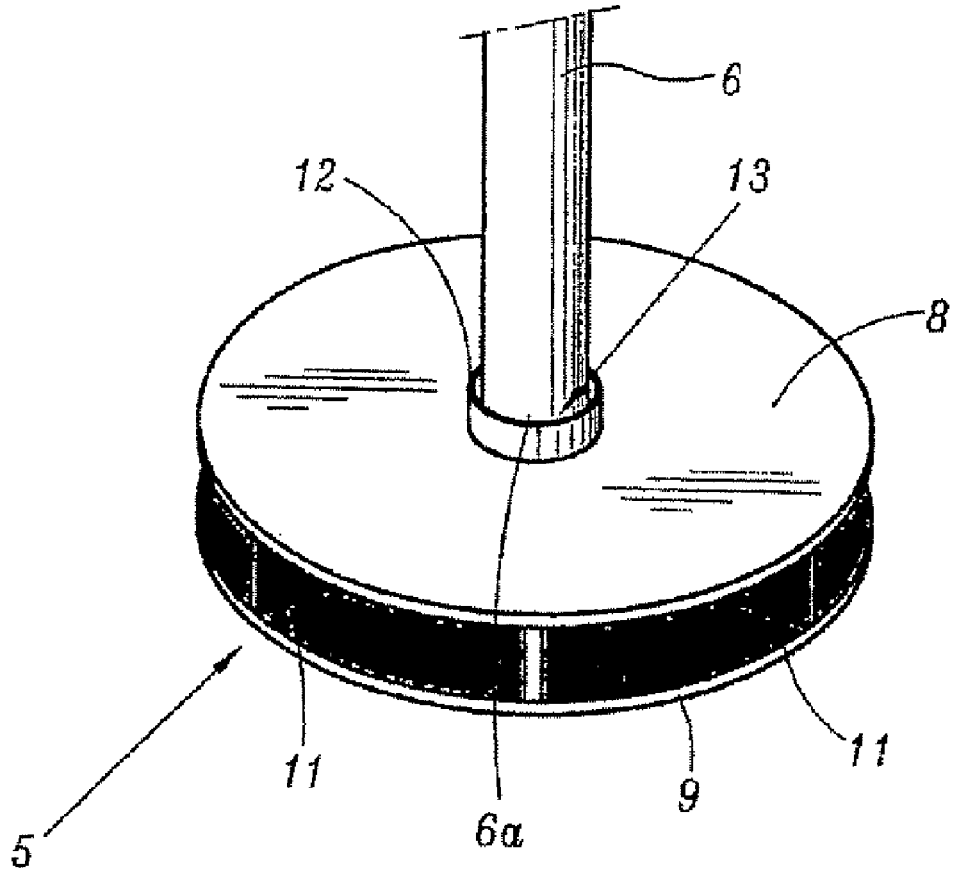
FIG 1B: PRIOR ART

DEVICE FOR STIRRING A LIQUID AND INJECTING A GAS INTO SAID LIQUID WITH LIMITED CLOGGING

BACKGROUND

The present invention relates to a device for stirring a liquid in a reactor and for injecting a gas into this liquid, employing a self-priming impeller.

Document EP-A1-0 995 485 describes a device for stirring a liquid in a reactor and for injecting a gas into this liquid. This device comprises a drive motor for driving a vertical shaft, which is arranged above the reactor. The shaft of the motor carries and drives at its lower end a propeller submerged in the liquid; it likewise carries and drives a self-priming impeller placed between the surface of the liquid and the propeller. The self-priming impeller is connected to a source of gas, generally an oxygenated gas, in such a way that, when it is driven by the shaft of the motor, it simultaneously sucks in gas and liquid in which it is submerged, thereby forming a gas/liquid dispersion. The gas/liquid dispersion generated by the self-priming impeller is directed toward the propeller with the aid of a baffle-forming annular casing which envelops the self-priming impeller.

It has been found that, under certain use conditions with this type of prior art device, the capacity to suck gas into the impeller was limited due to the volume defined by the impeller and the annular casing being clogged with gas. Thus, evacuating the gas/liquid mixture from the annular casing can only be done with difficulty: on the one hand, there is no dispersal of the gas into the reactor and, on the other hand, the gas present under the annular casing attempts to escape through the means for admitting the liquid into the impeller, which results in no gas being transferred into the liquid and in the gas being wasted, the gas rising to the surface without being used.

SUMMARY

The object of the present invention is to propose a device of this type in which the capacity to suck gas into the impeller is increased.

To achieve this object, the invention relates to a device for stirring a liquid and for injecting a gas into this liquid as defined above, in which the surface area of the lower disk of the self-priming impeller is less than the surface area of the upper disk of said impeller.

BRIEF DESCRIPTION OF THE DRAWINGS

For a further understanding of the nature and objects for the present invention, reference should be made to the following detailed description, taken in conjunction with the accompanying drawings, in which like elements are given the same or analogous reference numbers and wherein:

FIG. 1A illustrates a schematic view of a typical device for stirring and injecting a gas into a liquid;

FIG. 1B illustrates a second schematic view of a typical device for stirring and injecting a gas into a liquid;

DESCRIPTION OF PREFERRED EMBODIMENTS

Figure 2:
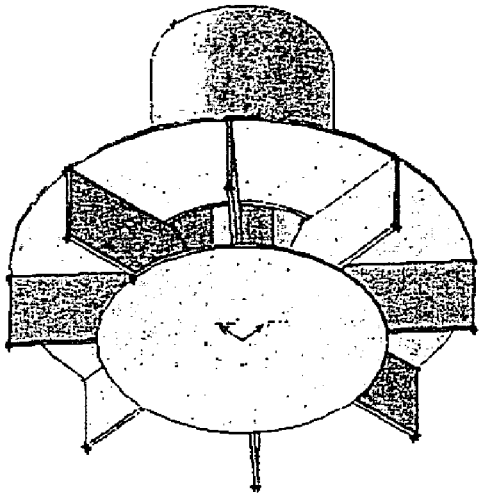
FIG. 2 illustrates one embodiment, according to the current invention, of a self priming impeller.

The object of the present invention is to propose a device of this type in which the capacity to suck gas into the impeller is increased.

In the text which follows, the term "reactor" denotes a natural "basin" and also a "tank" whose walls have a greater or lesser spacing and which is closed off at the top to a greater or lesser degree.

The invention therefore relates to a device for stirring a liquid and for injecting a gas into said liquid, comprising:

- a drive device arranged above the liquid, provided with a vertical output shaft equipped:
  - at its lower end with at least one axial-flow moving assembly submerged in the liquid, and
  - with an impeller submerged in the reactor and driven by the output shaft, the output shaft being enveloped coaxially by a cylinder whose lower end opens into the self-priming impeller and whose upper end is connected in a sealed manner to the drive device and is perforated with an opening for injecting a gas into an annular gap delimited by the shaft and the cylinder, the impeller being composed of two superposed disks and of a set of radial vanes arranged between the disks and fixed thereto, the upper disk being perforated with a central hole into which enters the lower end of the cylinder which delimits, together with the edge of said hole, an at least partially annular space through which liquid is sucked into the impeller,

- means for directing toward the axial-flow moving assembly the gas/liquid dispersion expelled radially by the impeller, and in which device the surface area of the lower disk of the self-priming impeller is less than the surface area of the upper disk of said impeller.

FIGS. 1A and 1B make it possible to characterize the device according to the prior art, which is improved by the present invention. The device according to the invention comprises a drive device (1), for example a motor, arranged above the surface of the liquid (L), provided with a rotary output shaft (2) extending vertically and partially submerged in the liquid (L). The shaft (2) carries at its lower end (3) an axial-flow moving assembly, preferably a propeller (4), submerged in the liquid. The shaft (2) also carries, arranged between the propeller (4) and the surface of the liquid (L), a self-priming impeller (5) which is consequently submerged in the reactor and is driven by the output shaft (2) at the same speed as the propeller (4). The output shaft (2) is enveloped coaxially by a cylinder (6) connected at its upper end (6*b*) to the drive device (1), with interposition of a sealing device (7), and whose lower end (6*a*) opens into the impeller (5) coaxially with the shaft (2). In the upper end of the cylinder (6) is made an opening (14) for injecting a gas into the annular gap (15) delimited by the shaft (2) and by the cylinder (6). The system for injecting gas into the orifice (14) is not represented.

The self-priming impeller (5) is composed of two disks (8, 9) placed horizontally and of a set of radial vanes (11) placed between the disks (8, 9) and fixed thereto. The essential characteristic of the invention stems from the nature of the self-priming impeller employed. According to the invention, the surface area of the lower disk (9) of the self-priming impeller (5) must be less than the surface area of the upper disk (9) of said impeller. This characteristic may be obtained by employing various types of impeller.

In a first variant of the device according to the invention, the lower disk (9) of the self-priming impeller (5) may have a diameter which is less than the diameter of the upper disk (8). Preferably, the diameter of the lower disk (9) is at least greater than or equal to the diameter of the at least partially annular space (13) through which the liquid is sucked into the impeller. This type of impeller is illustrated by FIG. 2.

Figure 3:
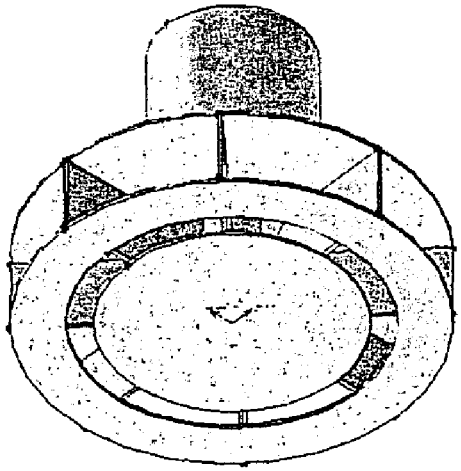
FIG. 3 illustrates another embodiment, according to the current invention, of a self priming impeller.

In a second variant of the device according to the invention, the lower disk (8) is at least partially cut out. By "cutting out" is meant the fact of removing part of the disk. The lower disk (8) may be, for example, at least partially cut out in the form of an annulus, that is to say that an annulus shape is removed from the lower disk. This type of impeller is illustrated by FIG. 3. Use may also be made of an impeller in which the whole of the center of the lower disk apart from an outer ring has been removed. In the latter case, the lower disk is now composed of nothing more than a metal ring. Use may also be made of an impeller from which has been removed at least one angular sector, preferably a plurality of symmetrically distributed angular sectors.

Finally, it is possible to combine these diverse variants and use impellers whose lower disk is partially cut out by combining various forms of cutout, such as an annulus cutout and a sector cutout. Thus, use may be made of an impeller in which some angular annulus sectors are cut out.

The output shaft (2) passes axially through the disks (8, 9) of the impeller (5) while being fixed to the lower disk (9), so that, when the drive device (1) is actuated, the shaft (2) drives the impeller (5) and the axial-flow moving assembly (4) in rotation at the same speed. The rotation of the impeller (5) creates the suction to suck in the gas arriving through the orifice (14), by way of the cylinder (6), and also the suction to suck in part of the liquid which is introduced through the annular gap (13) left free between the impeller (5) and the cylinder (6).

The device according to the invention comprises means for directing toward the propeller (4) the gas/liquid dispersion expelled radially by the impeller (5) between its vanes (11). According to the preferred embodiment, these means may comprise a baffle-forming annular casing (16) enveloping the impeller (5) and profiled so as to direct toward the axial-flow moving assembly (4) a stream issuing radially from the impeller, said annular casing being perforated with two superposed central openings (17, 18) coaxial with the shaft (2). Preferably, the diameter of the lower opening (18) is greater than the diameter of the upper opening (17) and substantially equal to the diameter of the upper disk of the self-priming impeller (5). The means for directing the gas/liquid dispersion toward the propeller (4) may also comprise a set of substantially vertical plates (19), forming counter-blades, arranged radially around the baffle casing (16) and fixed thereto. To this end, each counter-blade (19) radially enters the interior of the baffle casing (16); to which it is fixed by suitable means, for example welding or riveting. The counter-blades (19) may be arranged around the self-priming impeller (5) and the propeller (4) in a suitable number at specified angular intervals. A notch (21) into which may enter ends of the blades of the propeller (4) is made in the inner edge of each counter-blade (19), at the level of the propeller (4).

A device according to the invention makes it possible to extend the clogging limit of a prior art apparatus of the same type. Thus, a device according to the invention operates normally and will make it possible to inject the gas into the liquid and to stir the liquid under conditions in which the prior art device for its part is clogged.

One advantage of the device according to the invention is that, at identical powers, the device according to the invention makes it possible to increase the flow rate of gas injected into the liquid by comparison with the device according to the prior art. This increase is at least 30%.

Another advantage is that the device according to the invention has simplified operation by comparison with the prior art device. Thus, no additional moving stirring assembly is placed on the output shaft below the self-priming impeller, unlike in the optimized version of the device according to the prior art.

Examples of Implementing the Device

Devices such as those described in FIG. 1 were equipped with various types of self-priming impeller.

A first series of impellers tested corresponds to the implementation of the first variant of the invention (surface area of the lower disk of the impeller less than the surface area of the upper disk of the impeller). The characteristics of these various impellers according to the first variant are defined in table 1 below.

TABLE 1

| Impeller | Diameter of the upper disk | Diameter of the lower disk |
|---|---|---|
| Impeller 0 (prior art) | 80 mm | 80 mm |
| Impeller 1 | 80 mm | 0 |
| Impeller 2 | 80 mm | 50 mm |
| Impeller 3 | 80 mm | 60 mm |

Other tests were carried out with an impeller corresponding to the implementation of the second variant of the invention (diameter of the two disks identical and lower disk of the impeller partially cut out). The impeller tested, denoted Impeller 4, has disks with a diameter of 80 mm and its lower disk has had removed from it a 5 mm wide annulus at a distance of 25 mm from the center of the disk.

The gas clogging of the stirring devices according to FIG. 1 equipped with the various impellers 1 to 4 was compared with the clogging of the prior art device equipped with the impeller 0 and with an additional moving stirring assembly placed on the output shaft below the impeller 0. In order to detect clogging, the flow rate of gas into the device was increased while keeping the speed of the drive device constant. The gas employed is air at a pressure of 2 bar absolute. Clogging is detected visually by observation, on the one hand, of the cessation of the dispersal of the gas into the reactor and of, on the other hand, of the evacuation of the gas through the means for admitting the liquid into the impeller (annular space 13).

Figure 4:
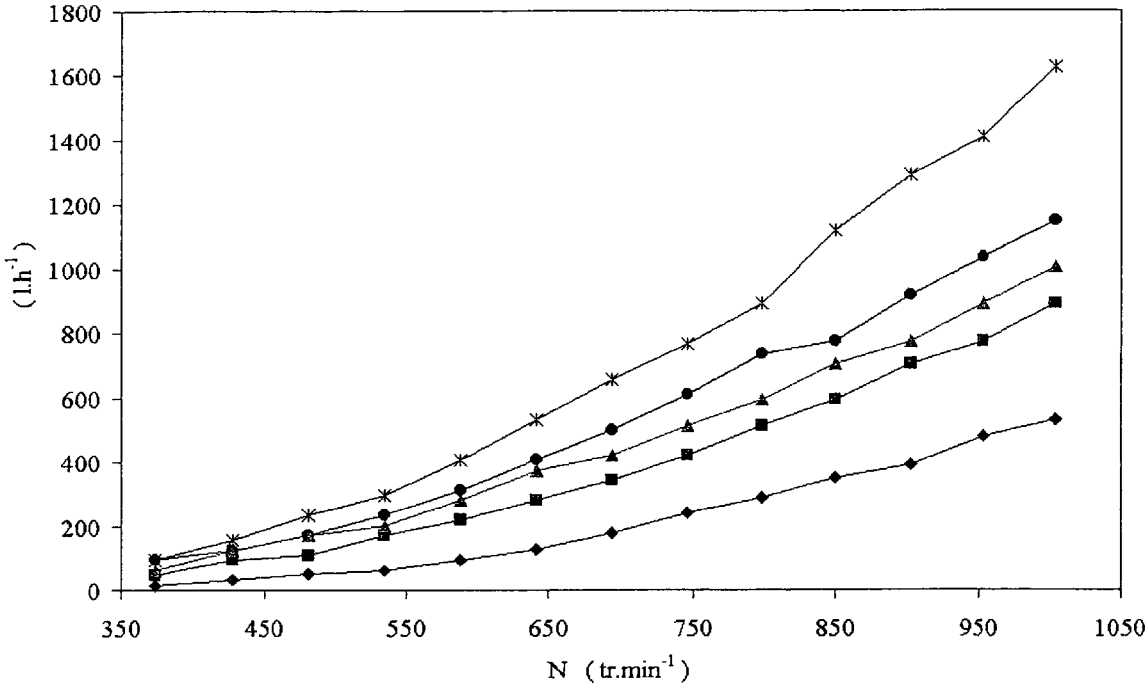
FIG. 4 illustrates a clogging limit curve showing curves for a typical device and for several embodiments of the current invention.

The graph in FIG. 4 represents for each device in FIG. 1 equipped with the impellers 0, 1, 2, 3 and 4 the gas flow rates (Q in l/h) observed upon clogging for various speed of rotation values (N in $min^{-1}$). It is found that, at identical speed, the devices employing the impellers 1 to 4 are clogged at much higher gas flow rates than is the case for the device employing the impeller 0.

By using numerical simulation the negative pressures generated by each of these impellers in the cylinder (6) surrounding the shaft (2) and in which the gas circulates were also calculated. The negative pressures were characterized by measuring the Euler number and are collated in table 2. The Euler number signifies the capacity of the device to induce gas into the impeller: the higher the number the greater the negative pressure created by the impeller in the cylinder (6). The Euler number is calculated in the following way: $Eu=\Delta P/(\rho_L(ND)^2)$, where $\Delta P$ is the negative pressure generated by the impeller in the cylinder (6) expressed in Pa, D is the diameter defined by the blades of the impeller expressed in m, N is the speed of rotation of the impeller expressed in $s^{-1}$, and $\rho_L$ is the density of the liquid expressed in $kg/m^{-3}$. D has a value of 80 mm for all the impellers tested.

TABLE 2

| Impeller | Euler number Eu |
|---|---|
| Impeller 0 (prior art) | 4.71 |
| Impeller 1 | 1.30 |
| Impeller 2 | 3.14 |
| Impeller 3 | 3.97 |
| Impeller 4 | 4.09 |

It is observed that, although the device according to the invention equipped with Impeller 1 makes it possible to extend the clogging limit considerably, it has a low Euler number and therefore a low gas-inducing capacity. The devices according to the invention equipped with Impellers 2 to 4 have a satisfactory Euler number while at the same time extending the clogging limits of the device according to the prior art (Impeller 0).

It will be understood that many additional changes in the details, materials steps and arrangement of parts, which have been herein described in order to explain the nature of the invention, may be made by those skilled in the art within the principle and scope of the invention as expressed in the appended claims. Thus, the present invention is not intended to be limited to the specific embodiments in the examples given above.

What is claimed is:

1. An apparatus which may be used for stirring and injecting a gas into a liquid located in a container, wherein said apparatus comprises:

a) a reactor, wherein said reactor contains a liquid;

b) a drive device located above said reactor, wherein:

1) said drive device comprises a vertical output shaft;

2) said output shaft comprises at least one axial-flow moving assembly; and 3) said axial-flow moving assembly is:

i) located at a lower end of said output shaft; and ii) substantially submerged in said fluid;

c) a cylinder located around said output shaft, wherein:

1) said cylinder comprises both an upper and a lower cylinder end; and 2) said upper cylinder end:

i) is substantially sealed to said drive device; and ii) comprises an opening for injecting a gas into an annular gap between said output shaft and said cylinder;

d) a self-priming impeller, wherein:

1) said impeller is submerged in said liquid and is capable of being driven by said output shaft; and 2) said impeller comprises:

i) a substantially planar upper disk, wherein:

aa) said upper disk is perforated with a central hole;

bb) the edge of said central hole and said lower cylinder end form an at least partially annular space; and cc) said liquid is sucked into said impeller through said annular space;

ii) a lower disk, wherein the surface area of said lower disk is less than the surface area of said upper disk; and iii) a set of radial vanes located between, and attached to, said upper and said lower disks; and e) a direction means for directing a gas/liquid dispersion expelled radially from said impeller toward said axial-flow moving assembly, wherein said lower disk is at least partially cut out.

2. The apparatus of claim 1 wherein the diameter of said lower disk is less than the diameter of said upper disk.

3. The apparatus of claim 2, wherein said diameter of said lower disk is greater than or equal to the diameter of said partially annular space.

4. An apparatus which may be used for stirring and injecting a gas into a liquid located in a container, wherein said apparatus comprises:

a) a reactor, wherein said reactor contains a liquid;

b) a drive device located above said reactor, wherein:

1) said drive device comprises a vertical output shaft;

2) said output shaft comprises at least one axial-flow moving assembly; and 3) said axial-flow moving assembly is:

i) located at a lower end of said output shaft; and ii) substantially submerged in said fluid;

c) a cylinder located around said output shaft, wherein:

1) said cylinder comprises both an upper and a lower cylinder end; and 2) said upper cylinder end:

i) is substantially sealed to said drive device; and ii) comprises an opening for injecting a gas into an annular gap between said output shaft and said cylinder;

d) a self-priming impeller, wherein:

1) said impeller is submerged in said liquid and is capable of being driven by said output shaft; and 2) said impeller comprises:

i) a substantially planar upper disk, wherein:

aa) said upper disk is perforated with a central hole;

bb) the edge of said central hole and said lower cylinder end form an at least partially annular space; and cc) said liquid is sucked into said impeller through said annular space;

ii) a lower disk, wherein the surface area of said lower disk is less than the surface area of said upper disk; and iii) a set of radial vanes located between, and attached to, said upper and said lower disks; and e) a direction means for directing a gas/liquid dispersion expelled radially from said impeller toward said axial-flow moving assembly, wherein said lower disk is at least partially cut out and said cut out is in the form of an annulus.

5. The apparatus of claim 1 wherein said axial-flow moving assembly comprises a propeller.

6. The apparatus of claim 1 wherein:

a) said directing means comprise a baffle-forming annular casing located around said impeller;

b) said annular casing directs a stream of said dispersion, radially from said impeller, towards said axial-flow moving assembly; and c) said annular casing is perforated with at least two central openings, wherein said openings are coaxial with said output shaft.

7. The apparatus of claim 1 wherein said axial-flow moving assembly is the final assembly located on said output shaft.

* * * * *